United States Patent [19]

Lombard

[11] 4,043,023

[45] Aug. 23, 1977

[54] METHOD FOR MAKING SEAMLESS PIPE

[76] Inventor: Daniel L. Lombard, 121 W. Boardman St., P. O. Box 177, Youngstown, Ohio 44501

[21] Appl. No.: 757,015

[22] Filed: Jan. 5, 1977

Related U.S. Application Data

[63] Continuation-in-part of Ser. No. 577,029, May 13, 1975, abandoned.

[51] Int. Cl.[2] ..... B22D 11/126; B22D 11/128

[52] U.S. Cl. ..... 29/527.6; 29/417; 29/526.4; 29/DIG. 47; 164/76; 164/85

[58] Field of Search ..... 29/412, 417, 527.7, 29/527.6, 527.5, 526.4, 526.5, 557, 558, DIG. 47; 164/76, 114, 84, 85

[56] References Cited

U.S. PATENT DOCUMENTS

| | | | |
|---|---|---|---|
| 1,607,475 | 11/1926 | Otto | 29/527.7 X |
| 1,945,087 | 1/1934 | Siegle | 29/526.5 |
| 3,490,135 | 1/1970 | Stein | 29/417 |
| 3,625,276 | 12/1971 | Considine | 164/84 |
| 3,672,038 | 6/1972 | Lombard | 164/76 X |
| 3,698,070 | 10/1972 | Sejournet et al. | 29/DIG. 47 X |
| 3,780,555 | 12/1973 | Balthazar et al. | 29/527.5 X |
| 3,927,450 | 12/1975 | Sommer et al. | 29/527.6 X |

*Primary Examiner*—Victor A. DiPalma
*Attorney, Agent, or Firm*—William J. Ruano

[57] ABSTRACT

A method for making seamless pipe from molten premium steel which is cast by a centrifugal process into hollow billets. The billets are then outer diameter turned, cut to length, and bored. By such centrifugal casting followed by machining, the inner diameter is formed in the billet without a piercing operation. The turning and boring also remove normal impurities in the billet. The billet is then heated and hot extruded in reduction ratios of high magnitude, from about 5 to 1 up to about 60 to 1 for converting large grain castings into fine grain size forgings or cold worked material.

2 Claims, 1 Drawing Figure

SCHEMATIC FOR NEW PROCESS TO PRODUCE SEAMLESS PIPE

SCHEMATIC FOR NEW PROCESS TO PRODUCE SEAMLESS PIPE
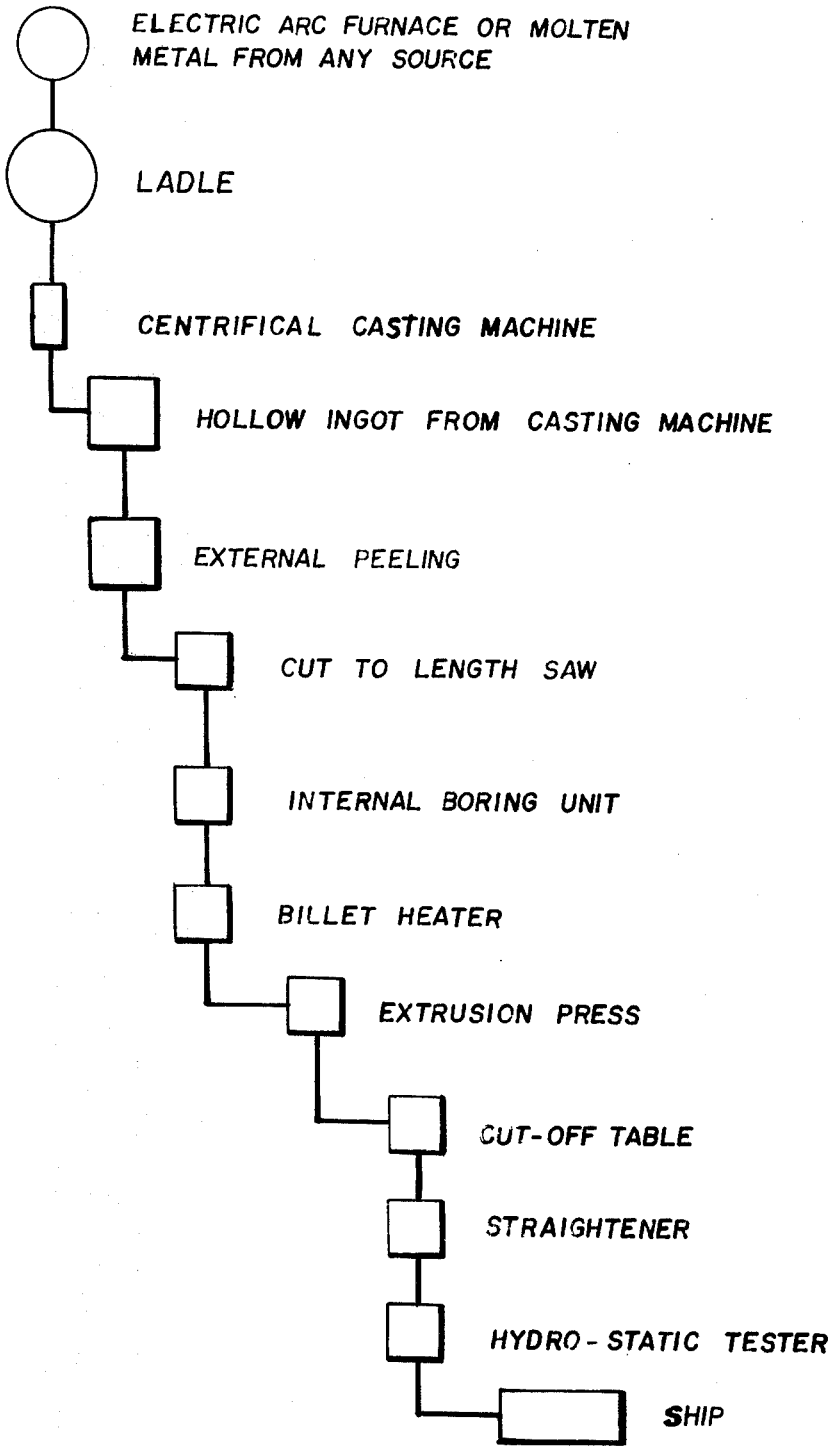

METHOD FOR MAKING SEAMLESS PIPE

This is a continuation-in-part of application Ser. No. 577,029 filed May 13, 1975, now abandoned.

This invention relates to a method of making pipe and, at the same time, improving the characteristics thereof.

An outstanding disadvantage of present methods of making pipe, starting from the molten metal stage, is that numerous successive steps or operations are required, including the manufacture of solid billets which require piercing in a piercing mill either by drilling or using a press, both of which processes involve additional operations and greater costs than required by the present invention.

Furthermore, known processes have included cold extrusion. However, when working cold, a maximum of 15 to 20% reduction can be attained on steel at which time the preform requires annealing prior to additional cold work.

An object of my invention is to provide a great improvement over said cold extrusion by performing the work on the preform hot. When extruding hot reductions of 500% (5 to 1) to 6000% (60 to 1) can be attained. Since the work is performed hot, no subsequent anneal is required.

Another object of my invention is to overcome the above-named disadvantages of conventional processes which include solid billets and to reduce the number of operations, as well as the cost of manufacture, by a very significant amount.

A more specific object of the present invention is to initiate the manufacture of pipe from the molten metal stage by the inclusion of centrifugal casting, followed by a machine operation, thereby eliminating the requirement of a piercing operation and at the same time permitting the removal of impurities in the billets.

Other objects and advantages will become more apparent from the study of the following specification taken with the accompanying drawing wherein:

The single FIGURE is a schematic illustration, in block diagram form, illustrating a novel process for producing seamless pipe in accordance with my invention.

Referring to the single drawing, molten metal is provided, either by an electric melt or other process. The molten metal is first poured into a ladle, thence, in accordance with chemical analysis for the alloy pipe to be produced, is fed into a centrifugal casting machine. In the process of centrifugal casting, any oxides or impurities in the molten metal will float to the inner surface or inside diameter of the hollow slug produced in the centrifugal casting. In normal static casting of steel ingots, these impurities float to the top of the ingot and would appear in the "hot top" of the ingot. Obviously, in a centrifugal casting there is no "hot top".

The product resulting from centrifugal casting is a round, hollow cylindrical casting. Since, as mentioned before, the impurities in the casting appear on the inside diameter of the casting, the inner surface of the casting must be bored out to remove these impurities.

The outside diameter of the centrifugal casting should also be turned (machined) since outside diameter imperfections can cause problems in final hot extrusion to pipe.

The machined (inside diameter and outside diameter) centrifugal casting is then cut to length to provide a suitable billet to be loaded in the hot extrusion press. The sequence of operations of boring the inside diameter, turning the outside diameter and cutting to billet length can proceed in any order without change in the process.

Once the hot extrusion billet has been prepared, that is , the outside and inside diamters cleaned up and correct length for extrusion, the billet is heated to hot extrusion temperature and loaded into the extrusion press. The hot extrusion temperature of the extrusion billet closely approximates the forging or rolling temperature required for the alloy processed.

The heated extrusion billet is loaded into the extrusion press. A mandrel is provided in the extrusion press to advance through the hollow centrifugal cast extrusion billet and a ram abuts the annular surface of the billet. A die having the outside diameter of the pipe to be produced is located in the extrusion press. As the main ram is actuated, the extrusion billet is forced to advance through the annular opening produced by the mandrel and die diameters. The hot extrusion process can readily exert reduction ratios (in this case initial annular area of billet to final annular area of pipe), of from 5 to 1 to 60 to 1, or even greater. These magnitudes of reduction ratios effectively break down the grain size of the centrifugally cast billets into grain sizes smaller than acceptable by hot working. The time for hot extrusion is measured in seconds; hence, the breakdown of grain size is accomplished in far less time than in the conventional process of hot working (i.e. rolling, forging, etc) since subsequent grain growth is a function of temperature and time the speed of hot extrusion provides for a minimum of subsequent grain growth.

Although finer grain structures can be attained by cold working in lieu of hot working, each cold worker operation must be followed by an annealing operation. Grain growth is a function of time and temperature, hence, the fine grain structure attained by cold working is to some extent, nullified by the subsequent annealing operation. In the final anaylsis, applicant's method will result in a grain structure and physical properties at least equivalent to that from cold working at far less cost.

After hot extrusion, the extrusion or finished pipe is removed from the extrusion press, straightened in a conventional manner (by press, roller straightening etc.), cut to shippable lengths, hydrostatically tested, and shipped.

Thus it will be seen that I have provided a novel and highly efficient method of making pipe, starting from the molten metal stage, which greatly reduces the number of manufacturing operations and greatly increases the physical properties by easy elimination of impurities and by change from large to fine grain size. Also, I have provided a novel method of producing seamless pipe which involves the making in an intermediate stage hollow billets by centrifugal casting and the use of a hot extrusion press; furthermore, I have provided a process for making seamless pipe which does not require making of solid billets which require piercing, either by drilling or by use of a press, both of which entail more operations at a greater cost.

While I have illustrated and described a single specific embodiment of my invention, it will be understood that this is by way of illustration only and that various changes and modifications may be contemplated in my invention and within the scope of the following claims.

I claim:

1. The method of making seamless pipe from molten metal, comprising centrifugally casting said molten metal to form a hollow ingot, externally peeling said hollow ingot and internally boring said ingot and cutting it to the desired length, thereafter heating the billet and subjecting the billet to a hot extrusion press for hot extruding the pipe for a period of seconds to enable high magnitude reduction ratios of about 5 to 1 to about 60 to 1, thereby considerably reducing grain size.

2. The method recited in claim 1 wherein the temperature of hot extrusion billet approximates the forging or rolling temperature required for the alloy processed.

* * * * *